US005444199A

United States Patent [19]

Burchard et al.

[11] Patent Number: 5,444,199

[45] Date of Patent: Aug. 22, 1995

[54] SWITCH FOR OPERATING AN ELECTRIC DEVICE, IN PARTICULAR A RADIO REMOTE CONTROL DEVICE

[75] Inventors: Thomas Burchard, Pforzheim; Wolfgang Bredow, Birkenfeld, both of Germany

[73] Assignee: NBB Nachrichtentechnik GmbH & Co. KG, Olbronn-Durnn, Germany

[21] Appl. No.: 170,836

[22] Filed: Dec. 21, 1993

[30] Foreign Application Priority Data

Dec. 28, 1992 [DE] Germany ..... 92 17 730.1 U

[51] Int. Cl.[6] ..... H01H 27/00

[52] U.S. Cl. ..... 200/43.04; 200/43.13

[58] Field of Search ..... 70/360, 408; 200/318, 200/43.04, 43.13

[56] References Cited

U.S. PATENT DOCUMENTS 1,309,135 7/1919 Honeywell ..... 200/43.07
4,174,472 11/1979 Josemans ..... 200/68
4,185,178 1/1980 Drees ..... 200/42 T

FOREIGN PATENT DOCUMENTS 2160192 6/1973 Germany .
9217730 2/1993 Germany .

*Primary Examiner*—J. Casimer Jacyna
*Assistant Examiner*—Timothy L. Maust
*Attorney, Agent, or Firm*—Spensley Horn Jubas & Lubitz

[57] ABSTRACT

A switch for operating an electric device, the switch having a released position in which the device can be switched on or off, and a locked position in which switching on of the device is prevented, in combination with a removable key element including a key insertable into the switch and displaceable for placing the switch in a selected one of the released and locked positions. The switch includes a function element fixedly disposed within the electric device, and an actuating element for switching the electric device on and off, seated on the outside of the device and in operative connection with the function element. The key element is composed of a cap-like slip-on element to which the key is permanently fastened and which is configured to be securely and removably mounted on the actuating element.

7 Claims, 1 Drawing Sheet

SWITCH FOR OPERATING AN ELECTRIC DEVICE, IN PARTICULAR A RADIO REMOTE CONTROL DEVICE

FIELD OF THE INVENTION

The invention relates to a switch for operating an electrical or electronic device, in particular a remote control device, with a released position in which the device can be switched on or off, and a locked position, in which switching on is prevented, and with a removable key for selecting the released/locked position, wherein the switch has function element, fixedly disposed in the housing of the electric device, and an actuating element for switching on and off, seated on the outside of the device in operative association with the function element.

BACKGROUND OF THE INVENTION

The importance of such an assemblage of elements lies in that several functions can be integrated: on the one hand, the switch is intended to operate as a change-over switch, i.e. with displacement of the actuating element in respect to the function element, the device is brought from one switched state to the other (on/off), provided the switch is in its released position. A "normal" operation is here possible.

On the other hand, it should be possible to manipulate the switch in such a way that in the locked position, activation of the device is prevented, for which a key is used, with the aid of which the switch can be placed into the locked position, in which an actuation, in particular switching on, is no longer possible.

Such a key has the disadvantage that as a rule it must be removed from the switch in order not to interfere with the operation of the device, and particularly with the operator of the device, and as a result the key can easily be lost.

If the key is allowed to remain in the switch for this purpose, it hampers the function of the switch in its released position, in particular the function as a so-called "emergency shut-off switch" wherein the switch is used as an impact switch, i.e. it is rapidly actuated by pressure on the actuating element and the device is shut off in this way (for example, the radio connection is interrupted in a radio remote control device).

OBJECT AND SUMMARY OF THE INVENTION

It is therefore an object of the invention to maintain the above described functions of such a switch to the full extent, but to avoid the disadvantages which up to now were unavoidably connected with the use of a key element for setting the released position or locked position.

This object is attained in accordance with the invention in that the key is an integral part of a cap-like slip-on element which is securely maintained on the actuating element.

This key structure has the advantage that the key can basically always remain on the switch, particularly in the released position, so that the above described function as an "emergency cut-off switch" is not hampered but that, on the other hand, it is possible to remove the key when required and to store it separately if the device is intended to remain in its off state, for example when transmission is to be blocked in a radio remote control device.

To assure the secure and captive mounting of the key on the actuating element of the switch, in accordance with one embodiment of the invention, the actuating element has a frustoconical exterior shape with a cross section which is reduced in the direction toward the housing of the electrical device, and the interior shape of the slip-on element is adapted, with approximately the same shape, to the exterior shape of the actuating element in such a way that the slip-on element can be snapped on the actuating element with elastic deformation in an approximately interlocking manner and can be captively maintained there when the key element is inserted into the actuating element.

To make this structurally possible, the slip-on element suitably consists of a plastic cap in the edge area of which at least two slits have been cut in the slip-on direction, so that the edge area can elastically widen during slipping on and slipping off of the slip-on element with the key.

Further embodiments will be described below. An exemplary embodiment of the switch of the invention will be described with reference to the drawings.

DESCRIPTION OF THE PREFERRED EMBODIMENTS

Figure 1:
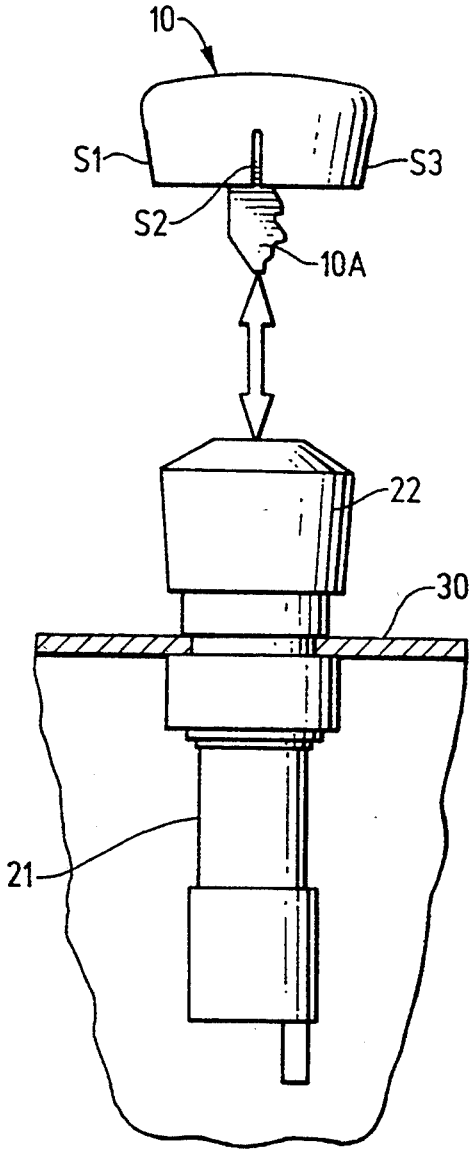
FIG. 1 is a side view of a switch with a key removed.

Referring to FIGS. 1–4, a lockable function element 21 is installed on the inside of the device in a housing 30 (only shown in the vicinity of the switch in the drawings) in the customary manner. An actuating element 22 is located coaxially to the function element 21 on the outside of housing 30. Actuation of the switch takes place by pushing the actuating element 22, embodied key-like, whereby the desired switching operation (on/-off) is then generated in the function element 21.

A lock having a keyhole (not shown in the drawings) for the axial insertion of a key 10A into the actuating element 22 is located in the front face of the actuating element 22. By its actuation, i.e. by turning the key 10A by 90°, for example, the on/off function of the switch can be blocked, for example for preventing its operation by unauthorized persons. This is of particular importance if it would be possible that considerable damage could be caused by such unauthorized operation of, for example, a radio transmitter remote control device, or that it could even be possible that people were endangered.

In accordance with the invention, key 10A is an integral part of a cap-like slip-on element 10 having an actuating surface 10B, domed toward the outside, and a frustoconically-shaped exterior form with a diameter which decreases in the direction toward housing 30 of the electrical device. In this case the interior form of the slip-on element 10 at least roughly corresponds to the exterior shape of the upper area of the actuating element 22, so that the slip-on element 10 can be snapped on the actuating element 22 in the direction of the two-headed arrow in FIG. 1. In the course of this slip-on movement, key 10A will be manually aligned with, and enters, the keyhole in actuating element 22 sufficiently deeply, so that actuating element 22 can then be switched from the locked position to the released position and vice versa.

To make this snapping-on possible, in the exemplary embodiment illustrated the annular edge area of the slip-on element has, for example, four slits S1 . . . S4 pointing in the slip-on direction and opening in the direction toward housing 30 which, together with an appropriately selected elastic plastic material for the slip-on element 10, allow the widening of the slip-on cross section (arrows F in FIG. 3), and thus assure the simple slipping on and removal from the actuating element 22, but on the other hand, in the slipped-on position (FIG. 2) the secure and captive mounting of key 10A in actuating element 22.

Figure 2:
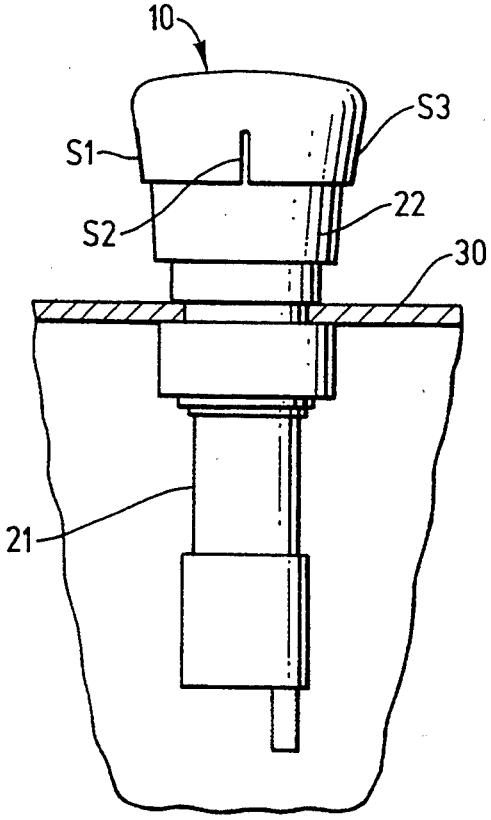
FIG. 2 is a side view of the switch of FIG. 1 with the slip-on element attached.
Figure 3:
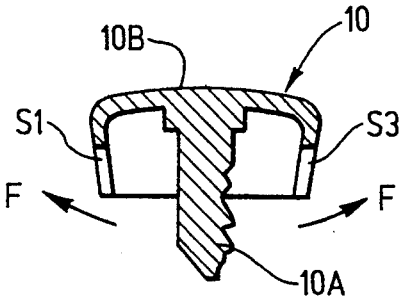
FIG. 3 is a longitudinal cross section through the slip-on element with the integrated key.

In the released position of the switch, key 10A is in the actuating element, i.e. in the position shown in FIG. 2. Because of the mushroom-like design of the slip-on element 10, the inserted key element 10A does not hinder the function of the switch, because the actuating element 22 can continue to be operated in the usual way and the function as an "emergency shut- off switch" in particular remains assured.

If the device is to be blocked, slip-on element 10 with key 10A can be turned on the actuating element 22, for example by 90°, and then removed.

Figure 4:
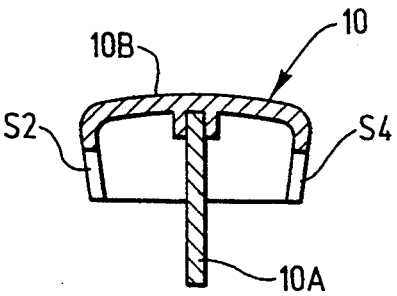
FIG. 4 is a cross-sectional view showing the slip-on element in a plane perpendicular to that of FIG. 3.

As shown in FIG. 4, actuating surface 10B may be provided with a receiving slot, at its inner surface, and key 10A may be a metal part which is inserted and fastened, for example by glue or cement, in the receiving slot.

This application relates to subject matter disclosed in German Application number G 92 17 730.1, filed on Dec. 28, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A switch for operating an electric device, said switch having a released position in which the device can be switched on or off, and a locked position in which switching on of the device is prevented, said switch being manually operable, only when in the released position, for switching the device on or off, in combination with a removable key element including a key insertable into said switch and rotatable for placing said switch in a selected one of the released and locked positions, wherein said switch comprises a function element adapted to be fixedly disposed within the electric device, and an actuating element for switching the electric device on and off, seated on the outside of the device and in operative connection with said function element, and further wherein said key element comprises a cap-like slip-on element to which said key is permanently fastened and which is configured to be securely and removably mounted on said actuating element.

2. A switch in accordance with claim 1 wherein said actuating element has a frustoconical exterior shape with a small diameter end which faces toward the electrical device, and said slip-on element has an interior shape at least approximately corresponding to the exterior shape of said actuating element for permitting said slip-on element to be snapped onto said actuating element with elastic deformation in at least an approximately interlocking manner and to be captively maintained on said actuating element when said key is inserted into said switch.

3. A switch in accordance with claim 2 wherein said slip-on element is constituted by a plastic cap.

4. A switch in accordance with claim 3 wherein said plastic cap has an open end and is provided with at least two slits which extend from said open end in the slip-on direction, so that said plastic cap can be elastically widened at said open end during slipping on and slipping off of said slip-on element relative to said actuating element.

5. A switch in accordance with claim 2 wherein said slip-on element has a closed end with an outer convex surface which faces away from said actuating element when said slip-on element is mounted on said actuating element, and said closed end has an inner surface provided with a central region to which said key is fastened so that said slip-on element has a mushroom shape.

6. A switch in accordance with-claim 5 wherein said closed end of said slip-on element has a receiving slot at said inner surface, and said key is a metal part which is inserted and fastened in said receiving slot.

7. A switch in accordance with claim 1 wherein said switch is manually operable by pushing on said switch.

* * * * *